US012668934B2

(12) United States Patent
Tao et al.

(10) Patent No.: US 12,668,934 B2
(45) Date of Patent: Jun. 30, 2026

(54) BRIDGE GIRDER WITH HIGH CENTRAL-WALL-BEAM

(71) Applicants: Jianlin Tao, Richmond Hill (CA); Evan Tao, Richmond Hill (CA)

(72) Inventors: Jianlin Tao, Richmond Hill (CA); Evan Tao, Richmond Hill (CA)

( * ) Notice: Subject to any disclaimer, the term of this patent is extended or adjusted under 35 U.S.C. 154(b) by 778 days.

(21) Appl. No.: 17/909,944

(22) PCT Filed: Sep. 1, 2020

(86) PCT No.: PCT/CA2020/000104

§ 371 (c)(1),
(2) Date: Sep. 7, 2022

(87) PCT Pub. No.: WO2022/047568

PCT Pub. Date: Mar. 10, 2022

(65) Prior Publication Data

US 2024/0200290 A1 Jun. 20, 2024

(51) Int. Cl.
*E01D 19/12* (2006.01)
*E01D 19/08* (2006.01)

(52) U.S. Cl.
CPC ..... *E01D 19/125* (2013.01); *E01D 19/086* (2013.01)

(58) Field of Classification Search
CPC .. E01D 2/00; E01D 2/04; E01D 18/00; E01D 19/086; E01D 19/125
See application file for complete search history.

(56) References Cited

U.S. PATENT DOCUMENTS 427,836 A * 5/1890 Clarke ..... E01B 25/305 404/1
2,226,432 A * 12/1940 Heinze ..... E01B 25/08 104/247
5,231,931 A * 8/1993 Sauvageot ..... E01D 2/04 104/124
5,386,782 A * 2/1995 Dinis ..... E01D 2/04 104/30
6,198,994 B1 * 3/2001 McCrary ..... B60L 50/66 701/117

(Continued)

FOREIGN PATENT DOCUMENTS

CN 108103930 B * 4/2020 ..... E01D 19/04
JP H0412513 U * 1/1992

(Continued)

*Primary Examiner* — Gary S Hartmann

(57) ABSTRACT

A bridge girder system comprising a longitudinal central beam positioned at the median of a bridge and extending upward from a deck to a height greater than the height of vehicles traveling on the bridge. The central beam has a width less than its height and functions as a primary load-bearing member that transfers forces to supporting piers. At least one road deck is located on a side of the central beam, the road deck including a lane with parallel runways corresponding to vehicle wheel-paths. An opening section is formed between the runways and extends longitudinally through the deck to permit passage of air, rain, and snow through the structure. Optional features include parapets at lateral ends of the decks, thermal regulation elements within the runways, autonomous-vehicle guidance structures disposed along the central beam or the decks, and electrical power rails associated with the central beam.

19 Claims, 6 Drawing Sheets

(56) References Cited

U.S. PATENT DOCUMENTS

| | | | | |
|---|---|---|---|---|
| 6,249,724 | B1 * | 6/2001 | McCrary | G05D 1/0297 701/117 |
| 6,276,542 | B1 * | 8/2001 | McCrary | B61B 15/00 213/9 |

FOREIGN PATENT DOCUMENTS

| | | | | |
|---|---|---|---|---|
| JP | 2508235 | Y2 * | 8/1996 | |
| KR | 20080057448 | A * | 6/2008 | E01D 19/14 |
| KR | 20100052391 | A * | 5/2010 | E01D 21/00 |
| KR | 101820375 | B1 * | 1/2018 | E01D 2/04 |

* cited by examiner (a)

(b)

(a)

(b)

BRIDGE GIRDER WITH HIGH CENTRAL-WALL-BEAM

FIELD

The present disclosure is in the field of civil engineering, architecture, city planning, public transit system, road design, construction, bridge structural design, beam design, aerodynamics, traffic efficiency, traffic safety, self-driving vehicles, independent axle extension, and especially a bridge girder design with central-wall-beam and open deck for autonomous-driving passenger buses and rubber-tyred trams, as well as other vehicles.

BACKGROUND

An elevated road, or bridge, is a raised road for its entire length. This elevation is usually achieved by constructing a viaduct, typically in the form of a long pier bridge. Technically, the entire elevated road is a single bridge that is typically constructed to provide passage over physical obstacles such as rivers, valleys, or roads. All the present disclosure will apply equally to the bridge, viaduct, and elevated road. For the purpose of maintaining simplicity and generality, the term bridge will be mostly mentioned in the context of the present disclosure, but it is interchangeable with viaduct and elevated road. Whenever the term bridge is used, the term viaduct and/or elevated road may also be implicitly included hereinafter.

There is an ongoing need to improve the structural design of bridges so that they can be built with better weather resistance, greater spanning distances, higher structural quality, affordable pricing, reduced construction difficulty, and faster construction speed. Bridges come in many structural forms, which are characterized by how they distribute forces such as bending, tension, compression, shear, and torsion. The most common structural forms include, but are not limited to, beam, cantilever, arch, truss, suspension, and cable-stayed bridges. Various construction materials are used to build such structures. The most common materials used for modern bridge construction are concrete, steel, or a combination of both known as reinforced concrete. In the case of the latter, the tensile strength of steel and the compressive strength of concrete work together to allow the members to sustain the bridge stresses over considerable spans. Due to shorter construction time and lower manufacturing and maintenance costs, both concrete and reinforced concrete became the world's most common building materials for bridges. Overall, the material used, structural elements, and what is carried (i.e. passengers or vehicles) affect the design of the bridge structure.

A beam bridge consists of one or more beams laid across supporting substructures, such as abutments or piers. At each end of the bridge, the abutment supports the end of the entire bridge, while a pier supports each span between the abutments. Beam bridges are known for their simplicity, ease of construction, and lower cost. Modern beam bridges include a sub-category called girder bridges, which use one girder to support the load between two adjacent piers. The bridge surface is also referred to as the bridge deck. Each girder transfers the deck's load forces down to its pier. A girder's ability to support weight is dependent on its shape, material, and height. The performance of a girder bridge is also affected by the girder span, and traffic on the bridge.

Three common types of beams for bridges with tyred-wheel traffic include I-beams, T-beams, and box girders. I-BEAMS: Beams in the shape of the letter 'I' have flanges on the top and bottom. This type of beam is the most common due to its simple design and lower costs. They are commonly used in both the conventional rolled steel beam bridge design and the alternative plated beam bridge design, where flat pieces of steel form the flanges of the I-beams. Overall, this beam design has a high moment of inertia for its given volume, so they have higher stability with bending and shearing forces parallel to the web. They are also cheaper and easier to build and maintain. However, these beams cannot resist twisting or carry torsion efficiently. T-BEAMS: Beams in the shape of a 'T' have a flange on the top. These beams have higher compression strength to resist shear stress. However, they cannot handle tensile forces as well as I-beams. An inverted T-beam with a bridge deck on the top is used to mitigate this issue. BOX GIRDERS: Multiple walls make a tube-like enclosure in the girder structure. They are better for resisting torsion and can carry more load than other girders. Each girder also has greater strength per unit area, and there is quality assurance since the girders are made off-site. Box girders also have a reduced requirement for support points and require less maintenance due to the lack of exposed surfaces and edges. However, it is more expensive to make, especially steel girders, due to the amount of materials required. The maintenance, although less frequently required, is more difficult due to the need to access the confined space inside the box.

Regardless of the variation in design, the existing girder bridge structure faces multiple challenges. First, each girder of the bridge is heavy, so there is a need for structural supports integrated with the girder design to stabilize and support the bridge. The structural supports normally require additional vertical space, leading to a higher vertical height of the bridge structure. Higher bridges are generally less safe and require even higher clearance if another bridge is built over existing bridges.

Second, the heavy girders require more supporting substructures (primarily piers) within a certain length. In other words, it ultimately limits how far apart the two adjacent piers can be. Therefore, more piers and shorter girder spans are needed to cover a great distance. The structural supports include supporting latticework or trusses. The latticework or truss can distribute the compression and tensile forces acting on the bridge. However, their effectiveness is limited, and they do not ultimately solve the limited span of the girder bridge from one pier to the next.

Third, heavier girders require increased construction materials, longer construction time, and more maintenance. This is especially true for steel bridges. A way to cut down on these costs is to use concrete as the primary structural material. However, it is more brittle and cannot withstand the high tensile forces that steel could. The existing solutions to help support the weight of the bridge, as noted above, increase the total material usage and cost. If possible, modifying the design as a whole would be more cost-effective to make the girder bridge lighter.

The fourth major issue with existing bridges is their tolerance to strong wind forces. Dynamic energy from strong winds is transformed into pressure upon hitting a surface (e.g. bridge deck), hereinafter called the wind load. The typical formula for wind load (also known as the drag equation) is as follows: $F=(Cpv^2A)/2$, where F stands for wind force or wind load acting on the surface area A of a given object (e.g. pier, bridge). This wind load also factors in the drag coefficient C, velocity of the wind v, and density of air p; the latter is a constant of approximately 1.2 $kg/m^3$ but can change depending on temperature. Thus, a higher wind velocity or larger surface will cause the wind force to have a greater impact. The drag coefficient majorly varies with the bridge shape, inclination, and size. A bridge shape design with low drag coefficient leads to a low impact of the wind.

In the area of fluid dynamics, an eddy is the circular movement of a fluid and the reverse current via swirling, which is created when the fluid is subjected to a turbulent flow regime. A space devoid of downstream-flowing fluid is made on the downstream side of the object by this moving fluid. The fluid behind the obstacle then flows into the void, which forms a swirl of fluid on each edge of the obstacle. Shortly after, a short reverse flow of fluid upstream is formed towards the back of the obstacle. This phenomenon can be naturally observed behind a large bridge structure that faces the incoming wind. A lot of strong eddies are undesirable for the safety of both the bridge and traffic. Reducing the effective surface area of the structure that blocks the incoming wind is the key to attenuate or eliminate harmful eddies.

In general, wind load creates significant vibrations in the bridge structure. These vibrations may destabilize the bridge and ultimately affect its structural integrity, particularly if the bridge has a long span. In some cases, the flanges of the bridge girders may bend laterally. Overall, the bridge's service life decreases, and thus, the cost of ongoing maintenance increases. There is an increased concern for structural integrity when resonance amplifies the wind load's impact on the bridge. Resonance occurs when external energy is stored, amplified, and transferred to an object at its natural frequency if the external frequency is equal or close to the natural frequency. With vehicles on a bridge, the wind vibration is relatively small; however, if the bridge's natural vibration happens to match the frequency of wind vibration, the small wind energy can add up to the existing vibration within a short period of time to create a stronger vibration. In such a case, the vibration of the structure becomes strong enough to cause damage to the bridge structure and may ultimately tear down the bridge. A perfect example of this is the destruction of the Tacoma Narrows Bridge in 1940 due to resonance. This bridge had a deck-stiffening truss to withstand wind load; however, the truss was not sufficient for the entire span of the bridge. Other factors that contribute to the increased vibrations include the speed and the angle the wind is hitting the bridge.

Wind may also create traffic and safety issues on the elevated height of the bridge. As the vehicles are driving on the elevated road, which has a higher elevation than the surrounding trees, buildings, etc., the side wind effect plays a role in the vehicles' safe driving. In case the traffic is subject to wind force, the vehicles are at risk of tipping over, spinning out, or being blown off the bridge deck. This is especially true if one of the vehicles is tall, narrow, and light; its driving ability is ultimately reduced due to the loss of traction.

An existing solution to mitigate the wind load on traffic is the use of wind barriers such as wind fences, which can improve vehicle safety. This wind fence is installed at the sides of the road to reduce wind load on the vehicles, which prevents sudden shaking and generally improves aerodynamic stability. However, existing wind fence designs work better for bridges with lower heights, as well as in areas with weak winds and optimal geological conditions. Furthermore, existing windshield wall designs do not mitigate the vibrations itself and can increase the wind load to the bridge if the wind fences are too high.

Rain, hail, and snow create difficult driving conditions on bridges and also affect their structures. Excessive moisture may lead to the corrosion of steel components, which makes the material less effective and leads to structural deformation. Standing water can also lead to corrosion of steel components if not properly drained from the bridge. Under freezing conditions, water on the deck surface (e.g. standing water) could freeze and turn into ice, which creates a driving hazard. Moreover, accumulated ice and snow means that more maintenance via snow plowing is required for the deck of the bridge. A heated bridge deck can help quickly melt ice and snow.

The aerodynamic forces on the vehicles as they meet have a significant effect on the vehicle handling stability, particularly the vehicles are tall, narrow, light, speeding, and close to each other. When two vehicles pass each other in opposite directions, it causes strong turbulence in the narrow space between them. The turbulence shakes the vehicles and causes the tires to lose their grip on the ground surface.

To reduce or eliminate the risk of a head-on collision, a wider space between two opposing lanes is one of the existing solutions. It is common for ground traffic; however, the wider space will significantly increase the cost of the elevated constructions. Another solution is to separate the two lanes with barriers such as flower beds or Jersey barriers. However, such physical barriers lead to additional construction costs.

One type of physical barrier that prevents head-on and side collisions between vehicles going in opposite directions is the Jersey barrier. This barrier is a low concrete or plastic barrier placed in the middle of the road that separates traffic. Thus, head-on collisions, side collisions, and crossovers to opposite lanes are kept to a minimum. The Jersey barrier's height (approximately 80 centimeters) is sufficient for protecting smaller vehicles. However, it is not as suitable for larger vehicles such as buses and trucks; these vehicles might still tip over the barrier onto the other lane. In the case of extreme weather (e.g. tornadoes and hurricanes), the barriers can also be blown away if not anchored properly. This issue further slows traffic and increases the likeliness of accidents occurring. A taller barrier similar to the Jersey barrier might serve as a better traffic divider on girder bridges. A similar barrier on the outer side of the bridge road is called a parapet.

It is also important to consider the emerging use of self-driving vehicles on the bridge structure. Self-driving vehicles (SV), also known as autonomous-driving vehicles (AV), typically use a camera, as well as many other sensors, to continuously sense its surroundings and drive accordingly. Self-driving functions work best when there are remarkable landmarks such as buildings, but can also make use of the road lanes on the bridge deck. During poor weather conditions, the camera is not able to view its surroundings as readily due to the reduced visibility of the lanes. This reduced visibility also can occur in the case of glare. Thus, the camera and the internal system of self-driving vehicles are confused by the parameters of the surrounding area. If there are external devices and driving references to guide self-driving vehicles, this may facilitate the use of autonomous driving on bridges.

Due to the issues noted above, a lot of maintenance is required to ensure that the structural integrity and the stability of the bridge structure are up to standards. This would mean routine inspections to ensure that there are no loose, corroded, or damaged components. Any damaged components present would mean more materials and labor are needed to repair or replace the damaged part. As noted before, weather-related maintenance needs to be conducted, particularly snow and ice, on the deck of the bridge also need to be removed for traffic safety. Furthermore, regular maintenance on the bridge deck would also mean lower traffic efficiency due to the need to divert traffic. A significant modification to the bridge structure is needed to reduce the maintenance needed for its structure and safety.

Lastly, the existing girder bridge design normally comes with a bulky shape, often blocks city views, and is relatively uninspiring to view. Overall, it is not a remarkable structure in its community. Furthermore, its general maintenance costs may not serve as an ideal long-term investment in the community. However, aesthetic issues are minor in comparison to the structural flaws and possible safety issues of the existing girder bridge design.

The present disclosure provides a high-strength girder bridge design that improves upon the current concrete and steel solutions with a novel girder structure. The girder consists of a tall central wall-like beam, two parapets, open bridge decks with optional heated runways, driving guides for self-driving vehicles, and electric live rails for electric vehicles. Thanks to this unique design, the bridge structure now solves the problems by becoming more stable, using less material, and less costly to build and maintain. The new girder itself is lighter than existing structures, takes much less vertical space, and enables longer girder spans between supporting piers. The new bridge design can resist stronger wind load; therefore, vehicle safety is improved because the open decks allow wind to flow through and prevent eddies from forming under the vehicle. Snow, hail, and rain can also go through the open decks, further increasing vehicle safety on the bridge. The bridge design in the present disclosure also greatly facilitates self-driving vehicles and technologies. Thanks to the electrically-powered live rails in the middle of the bridge deck, electric vehicles are powered via collector shoes. Furthermore, the new design is not only for self-driving passenger buses and rubber-tyred trams, but also for vehicles with an independent dynamic axle adjustment system.

SUMMARY

The present disclosure provides a design for a modified girder bridge structure that comprises a tall and narrow central-wall-beam that separates two lanes of traffic in opposing directions, lower parapets on each side of the girder, open bridge decks with optional heated wheel paths, self-driving reference guides, and electric live rails. The design comprises at least the following components: (1) a girder that sits on top of reinforced piers; (2) a central wall-like beam comparable to traffic height located at the median of the bridge, which separates the two lanes for traffic heading in opposing directions. The wall beam is tall, hollow, and narrow; it serves to suspend and support the most of the girder's weight and load; (3) the open deck of each lane is hollow and contains two runways that match a vehicle's two wheel paths: one runway is situated close to the central-wall-beam, and the other is close to the parapet at the edge of the bridge girder; (4) the two wheel-path runways are equipped with AV (autonomous-driving vehicle) reference driving guides to ensure that the wheels are on their respective runways. The driving guides also protect and guide the wheel with a dynamic axle from moving too far outwards; (5) the whole girder has holes that hold prestressed cables or rebars to support the beams and decks.

The purpose of the design is to mitigate the issues with existing girder bridge designs using the improvements provided in the present disclosure, which include: (1) maximizing the structural efficiency of the strength-mass and stiffness-mass ratios with the tall and narrow central-wall-beam; (2) making the girder bridge lighter in weight with hollow decks; (3) increasing wind-resistance capability and reducing eddies from strong winds by modifying the deck and girder structure to allow wind to flow through the open decks; (4) providing a safer ride to vehicles on both of the windward side and leeward side of the tall central-wall-beam; (5) providing a safer ride to vehicles on hollow and heated decks, which remove water quickly from rain, hail, and snow; (6) lowering the deck height of the bridge with the central-wall structure to improve space utilization; (7) providing reliable self-driving reference guides and the ability to install sensors, wireless signal adapters, and traffic signs/signals on the central-wall-beam and parapets, so they can provide self-driving vehicles with a better reference to perform reliably; (8) reducing interference to traffic at ground level with a long span and/or slim pier capability; (9) reducing maintenance of the bridge structure with the combined improvements in the present disclosure; (10) improving the aesthetic look of the structure, unblocking obstructions to scenic views, and making it more remarkable.

DETAILED DESCRIPTION

Figure 1:
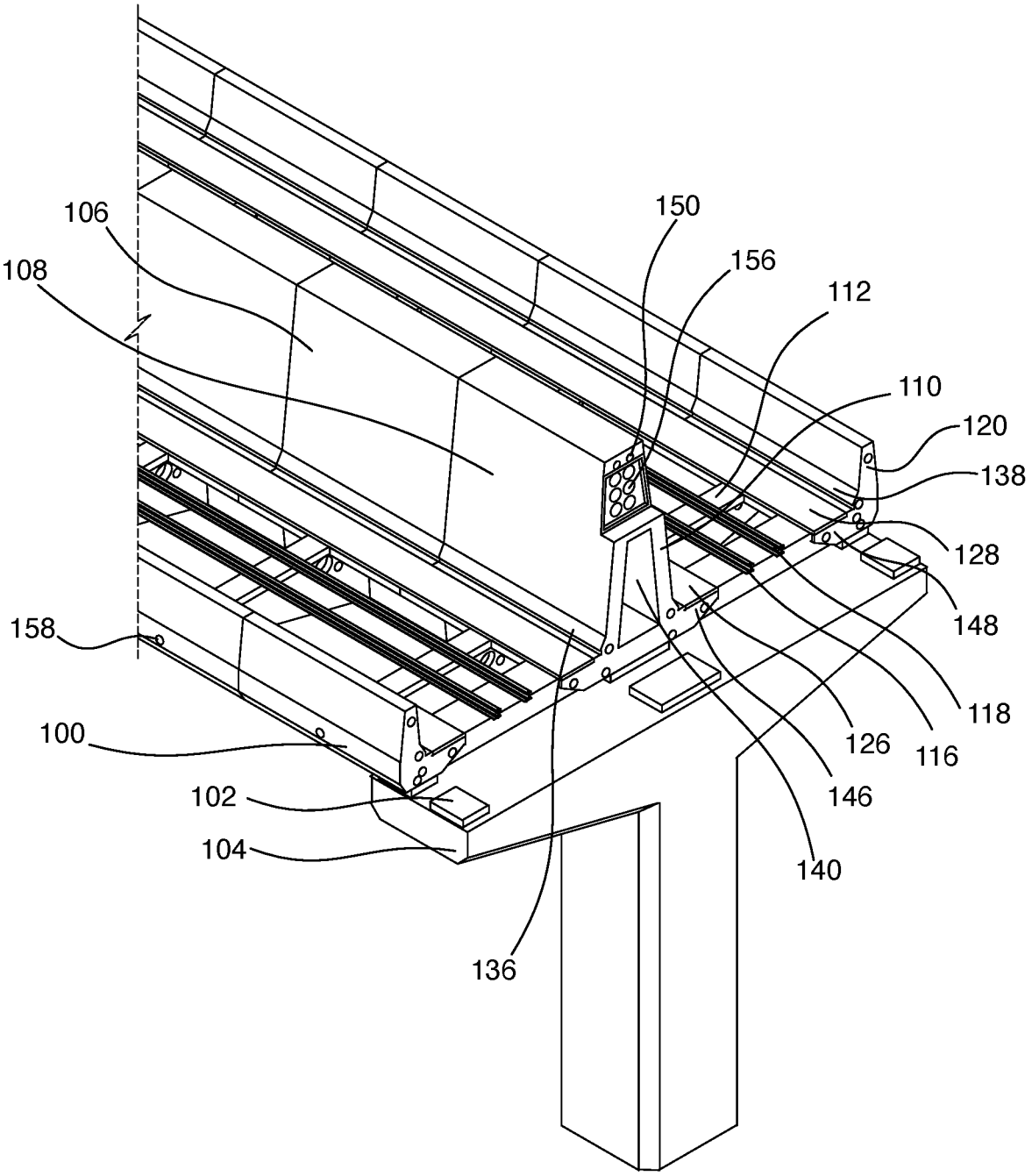
FIG. 1 illustrates an overall oblique view of the shape of the girder bridge structure constructed using a preferred embodiment of the present disclosure.

The language employed herein only describes particular embodiments; however, it is not intended to be limited to the specific embodiments of the disclosure. Within the disclosure, the term "and/or" includes any and all combinations of one or more associated items. Unless indicated, "a", "an", and "the" can encompass both the singular and plural forms within the disclosure. It should also be noted that "they", "he/she", or "he or she" are used interchangeably because "they", "them", or "their" are now considered singular gender-neutral pronouns. The terms "comprises" and/or "comprising" in this specification should specify the presence of stated features, steps, operations, elements, and/or components; however, they do not exclude the presence or addition of other features, steps, operations, elements, components, and/or groups. Unless otherwise defined, all terminology used herein, including technical and scientific terms, have the same definition as what is commonly understood by one ordinarily skilled in the art, typically to whom this disclosure belongs. It will be further understood that terms, such as those defined in commonly used dictionaries, should be interpreted as having the same meaning as defined in the context of the relevant art and the present disclosure; such terms will not be construed in a romanticized or overly strict sense unless explicitly described herein. It should be understood that multiple techniques and steps are disclosed in the description, each with their own individual benefit. Each technique or step can also be utilized in conjunction with a single, multiple, or all of the other disclosed techniques or steps. For clarity, the description will avoid repeating each possible combination of the steps unnecessarily. Nonetheless, it should be understood that such combinations are within the scope of the disclosure and the claims.

In the following description, specific details are mentioned to give a complete understanding of the present disclosure. However, it may likely be evident to one ordinarily skilled in the art; hence, the present disclosure may be applied without the mention of these specific details. The present disclosure is represented as one realization; however, the disclosure is not necessarily limited to the specific embodiments illustrated by the figures or description below. The description of the present disclosure will now be interpreted by specifying the appended figures representing preferred or alternative embodiments. All relative vehicles in the figures are illustrated with the right-hand traffic (RHT) in mind; however, the disclosure is not necessarily limited to the right-hand traffic, but can also apply to the left-hand traffic (LHT).

The present disclosure provides a design for a unique shape of the girder bridge structure that comprises a tall and narrow central-wall-beam separating two lanes of traffic for vehicles heading in opposite directions, lower parapets on each side of the bridge, open bridge decks with optional heated wheel paths, self-driving reference guides, and electric live rails. The term central-wall-beam is interchangeable with central wall-beam, wall beam, and central wall. The purpose of the design is to mitigate the issues with existing girder bridge designs using the improvements provided in the present disclosure, which include: (1) maximizing the structural efficiency of the strength-mass and stiffness-mass ratios with the tall and narrow central-wall-beam; (2) making the girder bridge lighter in weight with hollow decks; (3) increasing wind-resistance capability and reducing eddies from strong winds by modifying the deck and girder structure to allow wind to flow through open decks; (4) providing a safer ride to vehicles on both of the windward side and leeward side of the tall central-wall-beam; (5) providing a safer ride to vehicles on hollow and heated decks, which quickly remove water from rain, hail, and snow; (6) lowering the deck height of the bridge with the central-wall structure to improve space utilization; (7) providing reliable self-driving reference guides and the ability to install sensors, wireless signal adapters, and traffic signs/signals on the central-wall-beam and parapets, so they can provide self-driving vehicles with a better reference to perform reliably; (8) reducing interference to traffic at ground level with a long span and/or slim pier capability; (9) reducing maintenance of the bridge structure with the combined improvements in the present disclosure; (10) improving the aesthetic look of the structure, unblocking obstructions to scenic views, and making it more remarkable.

The design comprises a new girder design that sits on top of supporting structures such as piers. The girder can be manufactured with concrete, steel, or a combination of both in the form of reinforced concrete. The new girder comprises a unique tall and narrow central-wall-beam, which serves to suspend and support two hollow decks: one on each side of the central-wall-beam. The central-wall-beam is also hollow, so its weight is minimized. The whole girder has holes that embed tendons to support the girder and decks. The central-wall-beam, which is approximately the same as standard traffic height, acts as a barrier to separate the two lanes of traffic. Each hollow deck works as a roadway for a single lane of traffic heading in one direction of traffic. Though the traffic directions can be arbitrary, in one preferred embodiment of the present disclosure, the direction of one side of the central-wall-beam is opposite to the other.

Because the new design moves the supporting structures of T-beams, I-beams, or box girders from the girder bottom to the center, the supporting structure overlaps the vertical height of most vehicles. It effectively eliminates the need for extra vertical space. Therefore, the bridge can be made at a much lower allover profile, which includes the height of the bridge itself and vehicles on the deck. This optimizes the structural efficiency and space utilization.

With the same construction cost, this wall-like central beam structure can have a longer girder span than any other structural design. The longer girder span results in fewer piers needed for support. Using fewer piers can not only improve transportation on the ground level by minimizing the bridge's interference to ground-level traffic, road construction, and buildings; it also reduces construction costs and makes the whole construction process easier to implement. Because of the large girder span, the ground-level area under the bridge can now be designed with a center lane, also known as center left-turn lane and two-way left turn lane, to facilitate traffic turning. This will be elaborated in future paragraphs and in FIG. 5.

Each hollow deck, also known as open deck, may be divided into several lanes. Each lane is mostly hollow in the center with two deck portions, each under a vehicle's wheel path—say the left and right wheel path. The left and right deck portions are connected to the purlin. In an exemplary embodiment of the present disclosure that each deck has only one lane, one deck portion is situated near the central-wall-beam of the lane and the other close to the parapet at the other edge of the lane. The deck portion near the central-wall-beam is hereinafter called the near-wall runway; the deck portion near the parapet is hereinafter called the near-parapet runway. The parapets act as a smaller version of the central-wall-beam, located at the lateral ends of the girder. The surface of the two runways can be paved with asphalt, concrete, metal, engineering plastic, rubber, or other man-made materials. If used in cold-weather cities, the runways can be installed with heating devices that are powered by electricity, natural gas, or other energy sources. The heating is used to melt snow or ice, or dry out rainwater on the deck surface. There are also two electric live rails installed at the center of each lane that power electric vehicles.

Both the near-wall and near-parapet runways are slightly wider than the vehicle's wheels and are located under the vehicle's wheel paths. Above the near-wall runway, there is a driving guide shaped with a portion of the wall beam. It is called the near-wall driving guide. Above the near-parapet runway, there is a driving guide shaped with a portion of the parapet beam. It is called the near-parapet driving guide. The driving guides ensure that the vehicle wheels can properly drive on their respective runways. They are especially useful for self-driving vehicles equipped with sensors to measure the distance between the vehicle side and objectives. The driving guides also protect and guide the wheel with a dynamic axle from moving too far outwards.

The specific design described here is only for convenience to illustrate the basic idea of the present disclosure, but not to be regarded as a limitation of the design options. This includes variants in mechanical design to achieve similar features or functional purposes and variants with different materials, number of components, shapes, structures, and deployment orders, which are obvious in the eyes of those who are ordinarily skilled in the art.

FIG. 1 illustrates an overall oblique view of the unique shape of the girder bridge structure 340 constructed using a preferred embodiment of the present disclosure. The bridge consists of two main parts: the superstructure (100) and the substructure (104). The superstructure (100) is everything from the bearing pads (102) and up. The superstructure (100) between two adjacent substructures is called a girder. Most commonly, the girder is cast in segments. A girder is assembled with a series of girder segments with two types: end-girder segments (108) and mid-girder segments (106). The substructure (104) is the foundation that transfers loads from the superstructure (100) to the ground. The bottom of the mid-girder segments (106) and the top of the end-girder segments (108) has a set of holes, hereinafter called stay cable holes (156). The stay cable holes (156) have a role in holding stay cables and tubes; this will be explained in future paragraphs. The above-the-ground section of the substructure (104) consists of either piers or abutments. Moving forward, the terms substructure and pier are interchangeable and identified as (104). The superstructure (100) consists of decks and a supporting structure. The supporting structure consists of the primary support, the subordinate support, and their linkage. The primary support is a wall-shaped beam called the central-wall-beam or simply central-wall (110), which separates the two lanes for vehicles heading in opposite directions. The interior of the central-wall-beam (110) is a hollow chamber (140). The subordinate support consists of two parapet beams (120), also known interchangeably as parapets. The linkage between the primary support and subordinate support is a purlin (112). The girder also has smaller holes, hereinafter called tendon holes (150, 158), to route prestressed cables or rebars. The tendon holes (150,158) will be explained in future paragraphs.

The open decks consist of the near-wall runway (146) and near-parapet runway (148). These runways (146, 148) act as the roadway for each lane of the bridge. The pavement over the near-wall runway (146), which is close to the central-wall (110), is called the near-wall strip (126). The pavement on top of the near-parapet runway (148), which is close to the parapet (120), is called the near-parapet strip (128). The vehicle's wheels are rolling on these two strips (126, 128). Take the right-hand traffic (RHT) as an example. The left wheels are on the near-wall strip (126), and the right wheels are on the near-parapet strip (128). Two pieces of live rails (116, 118), which are mounted on the top of the purlins (112), are used to power electric vehicles (EV). Except for the purlins (112) and rails (116, 118), the section between the near-wall strip (126) and near-parapet strip (128) is hollow. The opening of this section is crucial to achieving the girder bridge's open deck concept in the present disclosure. Its significance will be explained further in later paragraphs. A driving guide is located next to each of the strips (126, 128), acting as steering references and boundaries for the wheels: a near-wall driving guide (136) is a portion of the central-wall (110) that is next to near-wall strip (126); a near-parapet driving guide (138) is a portion of the parapet (120) that is next to the near-parapet strip (128). In a sense, the driving guides (136, 138) function similarly to curbs to ensure that the wheels stay within the strips' (126, 128) top surface. The parapet (120) further secures the outer wheels on the near-parapet strip (128) and prevents the vehicle from going off the bridge. The central-wall (110) further secures the inner wheels on the near-wall strip (126).

Live rails (116, 118) are mounted on the top of the purlins (112). The purlins act as rail sleepers. The fasteners and isolation mean, such as the bolts, nuts, washers, clips, brackets, plastic pads, etc., are not shown in FIG. 1. The advantages of using electric live rails (116, 118) include little to no emissions, higher efficiency, and lower operating costs. One major disadvantage, however, is the susceptibility to power breakdowns. In an alternative embodiment of the present disclosure, the live rails (116, 118) are partially or fully replaced with one or more overhead power line(s). The voltage of the overhead power line(s) would be higher than that of the preferred embodiment; however, the overhead line is less reliable and requires more maintenance. Furthermore, the overhead equipment is not ideal for building multiple girder bridges on different levels due to the amount of vertical space that overhead lines require. The overhead line equipment would also be affected by strong winds and other adverse weather conditions, which may cause power breakdowns and affect the power supply given to the vehicle on this bridge.

The girder segments (106, 108) have holes that link each segment together with cables or rebars. This tensioning method of the preferred embodiment of the present disclosure is done in two stages. The first stage involves tendon holes (150) located throughout the girder to route post-tensioned cables or rebars. Once the cables are installed through the tendon holes (150), the following occurs: (1) the anchor plates/blocks are placed; (2) the cables are stretched using jacks; (3) the cables are anchored with wedges; (4) the tendon holes (150) are grouted; (6) the cable ends are trimmed and capped. Once the rebars are installed through the tendon holes (150), the following occurs: (1) the anchor plates/blocks are placed; (2) the rebars are stretched using jacks; (3) the rebars are anchored with wedges or nuts; (4) the tendon holes (150) are grouted; (6) the rebars are trimmed and capped. The sealing/filling of the tendon holes (150) and caps protects the cables and rebars from corrosion. The second stage of construction involves the stay cable holes (156) at the bottom of the mid-girder segments (106) and the stay cable holes (156) at the top of the end-girder segments (108). These stay cable holes (156) hold plastic cable tubes containing multiple stay cables. Each cable tube can be thermally welded or glued with couplers. Once the stay cables are installed through the stay cable holes (156) and the chamber (140), the following occurs: (1) the anchor plates/blocks are placed; (2) the cables are stretched using jacks; (3) the cables are anchored with wedges; (4) the tubes are grouted; (5) the cable ends are trimmed and capped. The sealing/filling of the stay cable tubes caps protects the cables from corrosion.

In another embodiment of the present disclosure, one more stage involving casting and tensioning is used to reduce on-site construction time, which also reduces joining epoxy usage and geometry control of the girder. Prior to the on-site erection, two or more mid-girder segments (106) can be joined on the ground. To increase the shearing strength, rebars are partially installed in the tendon holes (150) as reinforcement. The group of joined girder segments, hereinafter called great girder segments, are hoisted into place. Then, the next stage involving the linking and tensioning procedure is performed.

The construction of the improved girder of the present disclosure is presumably done with segmental precast, which can be facilitated with the use of a gantry to lift each girder segment or great girder segment. This method is a well-established construction method ideal for repetitive construction to save time and money, especially if the girders are pre-casted off-site. Other benefits of segmental precast include minimal disturbance, reduced environmental impacts, and reduced maintenance. The method of erecting segmental girders used in the present disclosure is the span-by-span method, which is the most common, fastest, simplest, and cheapest of the erection methods. It is ideal for longer bridges with multiple spans. The procedure for this method is as follows: (1) segments are lifted via the gantry and temporarily held in place; (2) post-tension cables are installed to let girder be self-spanning; (3) each girder is sequentially advanced and secured into place. It should be noted that though this method of construction is typically cheaper for short spans, it can become more expensive with long spans. Thanks to the novel design with a low-weight structure, the cost of construction equipment is reduced. The span-by-span erection with the long spans is still the ideal method in the present disclosure.

In yet another embodiment of the present disclosure, other erection methods related to segmental girders would be used. Other types of segmental girder erection include: (1) balanced cantilever erection; (2) progressive placement. BALANCED CANTILEVER: The deck is erected on each side of the pier in a sequence with cranes, gantries, or lifting frames. The segments are attached in an alternative manner at opposite ends of the cantilevers. By using this method, it minimizes load unbalance and longitudinal bending of piers. It is particularly useful with long girder spans or when the ground level below the bridge is hard to access (e.g. rough terrain or environmentally sensitive areas). PROGRESSIVE PLACEMENT: The girder segments are erected from one end of the bridge and placed in sequential order going in a single direction. Temporary piers are placed in the middle during construction. This method of construction is done in a single work location and is considered the most time-consuming. However, the process control is more straightforward, and the equipment required is relatively inexpensive. Furthermore, the bridge can be built with minimum disturbance to environmentally sensitive areas.

By modifying the design of the pier (104) and the end-girder segment (108), the bridge saves vertical space, which causes the lower deck elevation and total vertical space usage. The bearing pads (102) support the deck bottom. The lower portion of the central-wall-beam (110) below the deck and the upper portion of the pier cap use the same vertical space. It results in a lower deck elevation, and the modified girder bridge structure is less top-heavy compared to the existing box girder bridge. Also, the attached end-girder segments (108) are held more securely in place due to the wide lateral span. In addition, the girder (100) and the pier (104) have symmetrical structures. Given that there is only one lane for each direction, the load is better distributed for the increased stability. It also enables the construction of multiple modified girder bridge structures of the preferred embodiment at different height levels; this will be explained in future paragraphs and in FIG. 6.

The characteristics of the pier (104) may also vary; it ultimately depends on the surrounding environment where the bridge is constructed. In the case of the preferred embodiment of the present disclosure, the reinforced concrete pier (104) is situated on the ground with a solid fill, square column, and a hammerhead-shaped pier cap. Also, the solid fill is more suitable for piers (104) to minimize space usage. In other alternative embodiments, the pier (104) can be hollow. Hollow reinforced concrete piers (104) are used in tall bridges to maximize the structural efficiency of the strength-mass and stiffness-mass ratios. But, hollow piers (104) need more ground space and are more likely to block a driver's view of the ground traffic. The column of the pier (104) can be a variety of shapes that are suited for different applications. The sectional shape of the column can be a rectangle, octagon, circle, oval, etc. These shapes can be used in alternative embodiments of the present disclosure.

In an alternative embodiment, there can be two or more lanes for vehicles traveling in the same direction. Each lane is designated to a certain application. For example, one lane is for transit buses and rubber-tyred trams, while the other lane is for other traffic. In another case, one lane is for high-speed vehicles, and the other lane is for low-speed vehicles.

The design of the modified bridge girder structure is far more remarkable or attractive to look at. The bridge may gain enough recognition to be a defining structure for its residing area. Furthermore, the girder's design allows for the implementation of sensors, wireless signal adapters, and traffic signs/signals onto the structure itself. They can be installed on the central-wall-beam (110), the parapets (120), piers (104), etc.; this will be mentioned in future paragraphs and in FIG. 4. The sensors can also be integrated with the girder bridge structure to detect, report, and protect against adverse weather conditions such as rain, hail, snow, fog, etc.

Figure 2:
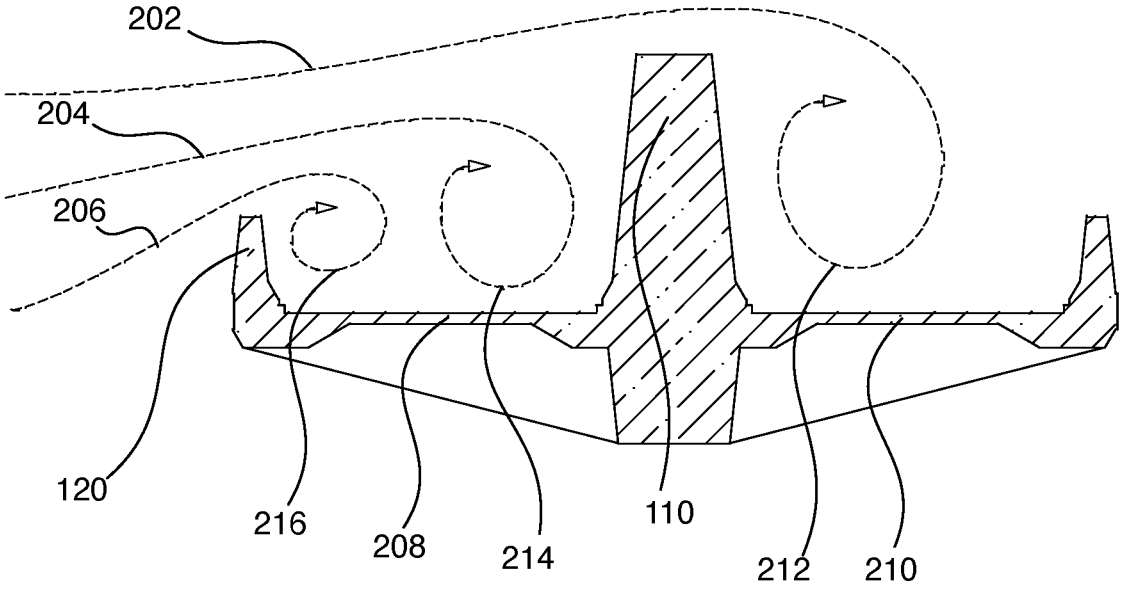
FIG. 2 illustrates the wind effects to a girder bridge with the central-wall-beam using the preferred embodiment of the present disclosure.
Figure 2:
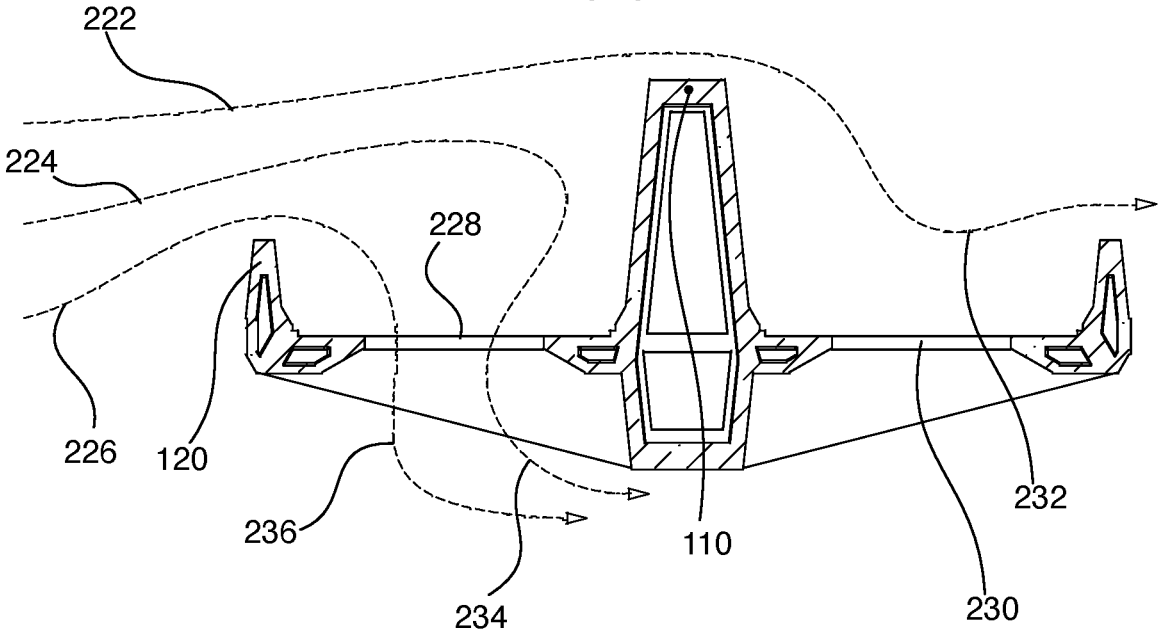

Like any elevated structures and objects, strong winds can apply force onto the girder bridge and vehicles. FIG. 2 illustrates the wind effects to the bridge with the central-wall-beam (110) using the preferred embodiment of the present disclosure. Sub-figure (a) illustrates the wind effects to the bridge when the entire deck is solid. The wind flow (206) overpasses the parapet (120) and forms a leeside eddy (216) on the deck (208) and the other side of the parapet (120). The wind flow (204) that travels over the parapet (120) would further deflect and create turbulence (214) on the deck (208) of the bridge. This eddy and turbulence will cause the strong wind force to be applied onto the bridge, shake the deck, and create unsafe driving conditions. The wind flow (202) overpasses the central-wall-beam (110) and forms a leeside eddy (212) on the deck (210) and the other side of the central-wall-beam (110). The leeside eddy (212) may also shake the deck (210) and vehicles, which generates unbalanced vibration. The stronger the passing wind (202, 204, 206), the more damaging the unbalanced vibration will be on the bridge. The wind-related issue gets worse if the wall beam (110) is tall. The higher the wall beam (110) is, the more likely it will break because the hazard torque is proportional to not only the wind strength but also the wall beam (110) height. Furthermore, all the vibrations caused by the wind could be amplified if the wind's frequency is close to the bridge's natural frequency; this creates resonance and can ultimately damage and bring down the bridge structure.

Sub-figure (b) illustrates the wind effects to the bridge in the preferred embodiment of the present disclosure. With the girder design in the preferred embodiment, the wind flow (224, 226) travels over the parapet (120), which is then directed towards the central-wall-beam (110). Due to the novel open deck design, the wind flow (224, 226) mostly deflects in the downward directions (234, 236) and leaks through the deck opening section (228). There might still be some turbulence created by wind flow (224, 226) but with a much smaller impact on the bridge structure, providing safer driving conditions. At the same time, the slightly deflected wind flow (222) overpasses the central-wall-beam (110) and then overpasses the right-hand-side parapet (120) along with the upward wind flow through the deck opening section (230). Due to the novel open deck design on the other side of the central-wall-beam (110), the hazardous turbulence and eddies are also significantly reduced.

Both Sub-figure (a) and Sub-figure (b) do not illustrate the wind effects to the bridge as wind flow passes under the girder. The major sections of the central-wall-beam (110) and parapet (120) are above the deck. So, the major effect of the wind force is applied to the section above the deck. A small amount of wind flow travels under the parapet (120), which is also deflected by the lower body of the central-wall-beam (110). This makes less turbulence or eddies and has a smaller effect on the girder structure.

Figure 3:
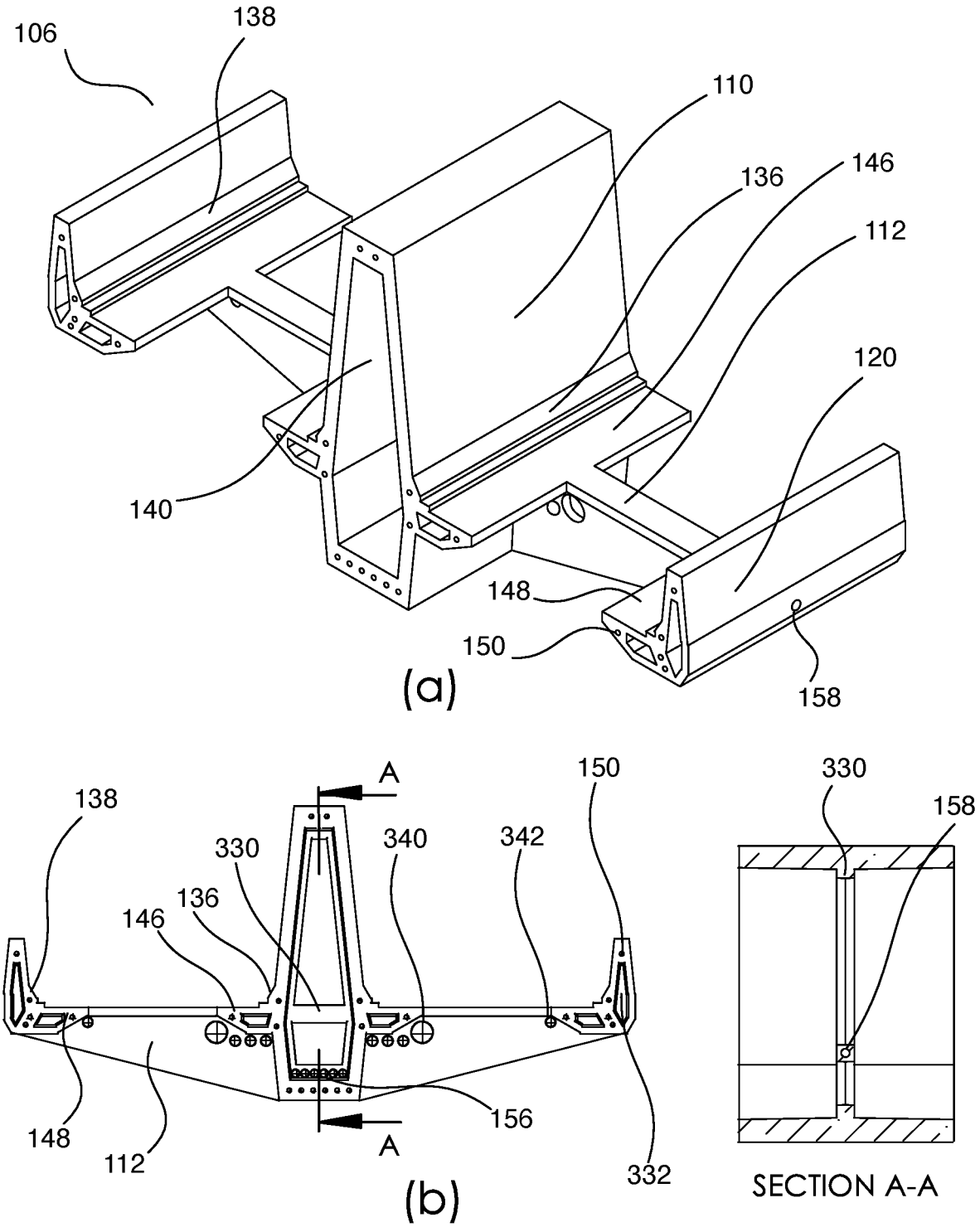
FIG. 3 illustrates an oblique, front, and section view of a mid-girder segment constructed using the preferred embodiment of the present disclosure.

FIG. 3 illustrates an oblique, front, and section view of the mid-girder segment (106) constructed using the preferred embodiment of the present disclosure. All descriptions of the girder in FIG. 1 also apply to each of the sub-figures of FIG. 3. Sub-figure (a) shows an oblique view of the girder segment. In this preferred embodiment of the present disclosure, the hollow chamber (140) is accessible for stay cable installation and inspection. The purlin (112) is designed as a T-beam, which is optimal for resisting shear stress and compression stress. In another embodiment of the present disclosure, the sectional shape of the purlin (112) can be a rectangle, I-shaped, triangle, trapezoid, oval, etc. Some of these shapes have less resistance to air flow and hold less standing water from rain, snow, and ice; however, it might lead to higher material usage. In addition to its supporting function, the purlins (112) are also used as sleepers of electric live rails. The driving guides (136, 138) on each side of each lane function as references for self-driving vehicles. This is to ensure that their wheels stay within the runways (146, 148) without falling into the opened spaces.

The central-wall-beam (110) design of the present disclosure serves three main purposes: (1) it provides strong support for both an open-structured girder and longer girder span with a very low deck elevation and lighter girder weight. As noted before, the central-wall-beam (110) replaces the traditional under-deck box girder, I-beam, or T-beam structure. The reasons for this low deck elevation will be explained in later paragraphs and in FIG. 6. The central-wall-beam (110) is tall, which results in a high load capacity and/or a long span. The central-wall-beam (110) is narrow, which results in a low horizontal space usage. This central-wall-beam (110) is hollow, which results in a low weight of the girder itself. In addition, the central-wall-beam (110) gives the girder a symmetrical design in order to better distribute the load-bearing from vehicles; (2) it protects the vehicles traveling beside the central-wall (110) from the impact of strong wind flow. The driving guides direct the wheels and prevent the wheels from drifting. The tall central-wall-beam (110) reduces the wind forces on both windward side vehicles and leeward side vehicles; (3) it physically separates and prevents vehicles in opposing directions from colliding into one another head-on or from the side. Its higher height, compared to a standard Jersey barrier, can securely accommodate larger vehicles, like passenger buses and rubber-tyred trams for public transportation. As two or more vehicles pass by one another, the central-wall-beam (110) reduces the likelihood of shaking vehicles by the sudden air turbulence. Along with the design of the open decks, vehicles can maintain good traction on the strips (126, 128), which are supported by runways (146, 148). The details of the open decks will be explained in future paragraphs.

The top of the central-wall-beam (110) and parapet beams (120) can also be used to install external sensors, wireless signal adapters, and traffic signs/signals to act as a better means of communication with on-bridge vehicles. Such sensors can vary in function, including, but not limited to: vision sensors to monitor the traffic and bridge condition, wind sensors to measure wind direction and velocity, ultrasonic sensors to detect incoming vehicle speed, deflection sensors to detect the bridge's overall load, etc. Signal transmitters and receivers communicate with vehicles, send data relating to the traffic conditions, weather, map data, etc., and receive data relating to vehicle requirements, vehicle condition, etc. Traffic signs and signals regulate the flow of traffic. All those sensors can be very useful for self-driving vehicles.

Sub-figure (b) illustrates a front view and section view of the mid-girder segment (106): all descriptions of the girder in Sub-figure (a) also apply here. The front view of this sub-figure also shows a central-wall rib (330) inside the chamber (140) of the central-wall-beam (110) and two parapet webs (332) inside the parapets (120) of the girder. Stay cable holes (156) are illustrated at the bottom of the central-wall rib (330), which is typical in a mid-girder segment (106). The sub-figure also illustrates additional holes at the purlin (112). These holes are hereinafter called large purlin holes (340) and small purlin holes (342). Some purlin holes (340, 342) are used to hold drainage, and the others are used to hold electricity and signal conduits.

Sub-figure (b) also illustrates a section view of the girder, labeled as Section A-A. It primarily shows the central-wall rib (330) and a tendon hole (158) to hold a prestressed rebar or cable for improved tensile strength. The tendon hole (158) shown in Section A-A is situated through the purlin (112), the parapet webs (332), and the mid bar of the central-wall rib (330).

The central-wall rib (330) and two parapet webs (332) enable the girder to be lighter and more compact, yet strong enough to support the girder and the load on the deck. As Section A-A in Sub-figure (b) shows, the mid-girder segment (106) is symmetrical. The central-wall rib (330), the parapet webs (332), and the purlins (112) are at the midplane of the girder segment; these components (330, 332, 112) act as transverse reinforcement. Thanks to this transverse reinforcement, the design significantly reduces the weight of the girder and the material cost. The mid bar of the central-wall rib (330) is at the same level as the top of the runways (146,148); it is the key to improving girder strength to resist twisting. In another embodiment of the present disclosure, two or more bar(s) of the central-wall rib (330) might be cast cross the chamber (140). Additional bars affect the access to the chamber (140). The parapet webs (332) enhance the strength of hollow parapets (120). In another embodiment of the present disclosure, the parapets are solid, so the webs are no longer needed.

The stay cable holes (156), which are cast at the bottom of the rib (330), are used to hold stay cables and tubes. Only some of the mid-girder segments (106), which are in the middle of the entire girder, use these holes at the bottom of the rib (330). For the rest of the mid-girder segments (106), the stay cables and tubes are overhanging through the chamber (140). In the chamber of some mid-girder segments (106), the stay cables are attached to the mid-girder segments (106) by brackets to spread the support of the girder evenly. Take the 10-segment girder as an example. First, count the segments in sequential order from one to ten. Segment 1 is the leftmost girder segment, and segment 10 is the rightmost girder segment; both of them are the end-girder segments (108). The stay cables and tubes are anchored in the stay cable holes (156) at the top of the end-girder segments (108). Segments 2 to 9 are the mid-girder segments (106), and only segments 5 and 6 uses the stay cable holes (156) to hold stay cables and tubes. The stay cables and tubes are overhanging through the chamber (140) of segments 2, 3, 4, 7, 8, and 9. Segments 3 and 8 are attached to the stay cables by brackets.

The open spaces between the runways (146, 148) and purlin (112) are key to achieving the following: (1) a lighter girder weight; (2) better resistance to wind load for both the vehicles and the girder; (3) easier dealing with rain, hail, and snow. THE FIRST ACHIEVEMENT: The lighter weight means a reduced amount of construction materials, ease of transportation and hoisting, less time to build, and less maintenance. The bridge does not need to support as heavy of a weight and is, therefore, more stable and lasts longer. Longer girder spans can be built with piers (104) being farther apart; such spans can save construction time and are easier to build. It also allows better integration with ground traffic; this will be explained in future paragraphs and in FIG. 5.

THE SECOND ACHIEVEMENT: The open decks prevent eddies from forming underneath the vehicles, the central-wall-beam (110) reduces the wind force onto the vehicle's side. As a result, the runways and strips (146, 148, 126, 128) keep the vehicle in place and allow the vehicles to maintain traction. This is further aided with the use of the tall central-wall-beam (110) to prevent vehicles from colliding into each other. Because the wall beam (110) is about the same height as a bus, it shadows vehicles passing by on both sides. As a result, it shifts the effects of wind load from the vehicles to the bridge. The combination of these two novelties means that vehicles are not greatly affected by the strong wind and sudden negative pressure. As a result, accidents relating to strong winds are greatly reduced if not eliminated. Furthermore, the combination of the open decks and the central-wall-beam (110) mitigate turbulence caused by wind load. This way, the vibration of the bridge structure is greatly weakened. It then becomes harder for the vibration to accumulate even if the bridge's natural frequency is similar to that of the wind. In other words, the resonance of vibrations is no longer likely to happen.

THE THIRD ACHIEVEMENT: The open decks allow rainwater, hail, or snow to fall directly through the bridge open decks without accumulation. In the case of the hail or snow, they are dropped on the strips (126, 128) and melted by heated strips. The water from ice or snow is then drained through the open spaces of the deck. With this novel design, vehicles can travel on the girder bridge in adverse weather conditions. Thanks to the melting of ice and snow by heated strips, the strips (126, 128) do not clog up or freeze. Therefore, strip heating makes driving safer and reduces maintenance costs. In another embodiment of the present disclosure, the purlin holes (340, 342) are used to hold gutters for the purpose of catching excess water from the girder during adverse weather conditions (i.e. rain, hail, or snow); this will be mentioned again in future paragraphs.

Figure 4:
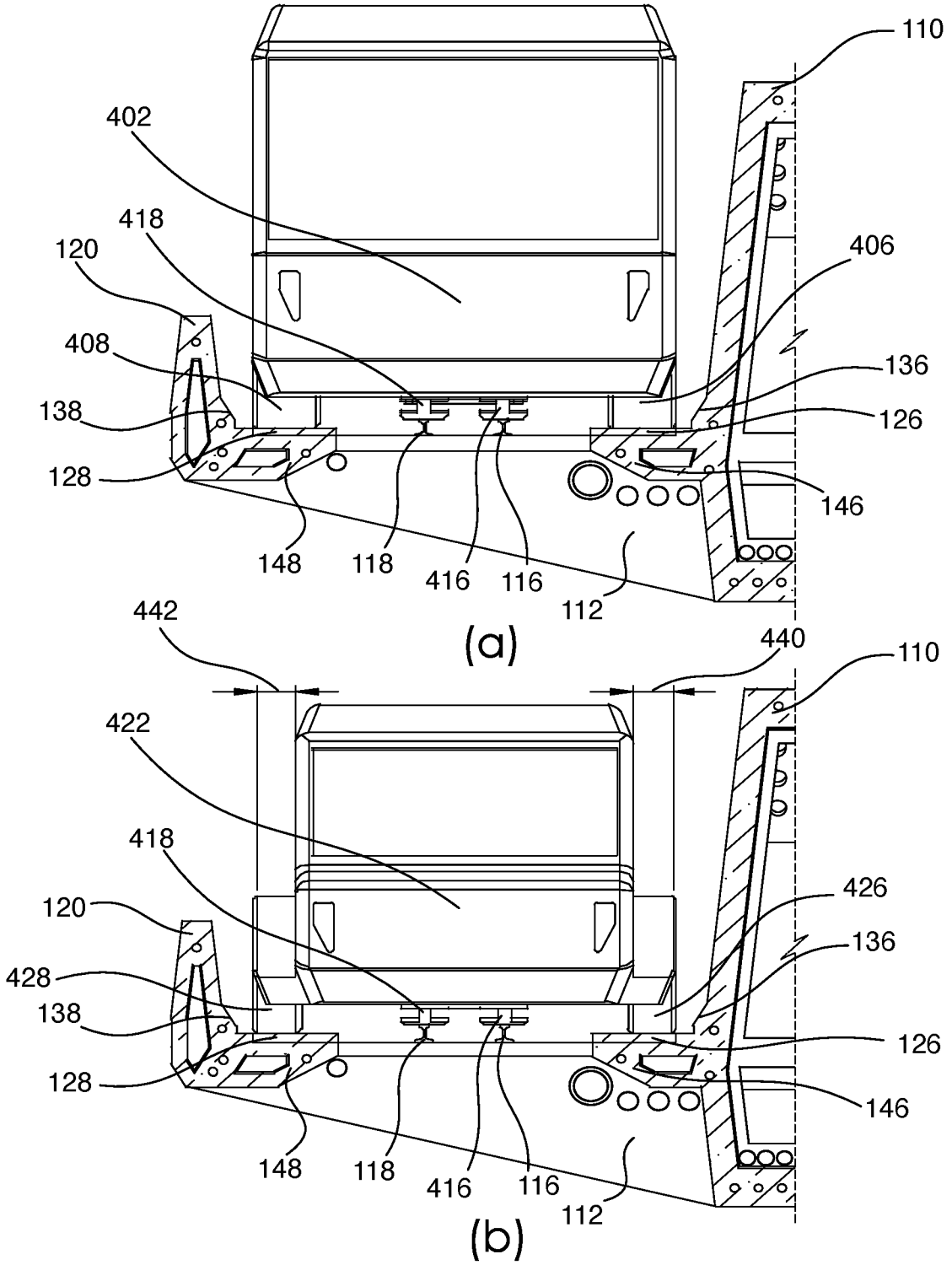
FIG. 4 illustrates the front views that different vehicles travel on the bridge deck of the preferred embodiment of the present disclosure.

FIG. 4 illustrates the front views that vehicles travel in one lane of the bridge deck in the preferred embodiment of the present disclosure. Sub-figure (a) illustrates a front view of one lane of the girder bridge and an electrically-powered rubber-tyred tram (402) traveling on it. The height of the central-wall-beam (110) is a little lower than that of the tram (402). In another embodiment of the present disclosure, the height of the central-wall-beam is taller than that of the tram. The taller wall beam results in a higher load capacity and/or longer span. The vehicle (402) has near-wall wheels (406) and near-parapet wheels (408). The near-wall wheels (406) are riding on the near-wall strip (126). The near-parapet wheels (408) are riding on the near-parapet strip (128). The near-wall wheels (406) should ideally always be aligned with the near-wall strip (126). The near-parapet wheels (408) should ideally always be aligned with the near-parapet strip (128). Sensors mounted beside the vehicle (402) body measure the vehicle to the central-wall (110) and vehicle to parapet (120) distances, which provide a reliable reference to the steering control system. It prevents wheels (406, 408) from physically coming in contact with the driving guides (136, 138). Electrically-powered live rails (116, 118) are bolted on top of the purlin (112). The rails (116, 118) power the electric vehicle (402) via collector shoes (416, 418).

Sub-figure (b) illustrates a front view of one lane of the girder bridge and an electrically-powered minivan (422), which features a dynamic axle system, traveling on it. The height of the central-wall-beam (110) is a little higher than that of the minivan (422). The minivan (422) has near-wall wheels (426) and near-parapet wheels (428). The near-wall wheels (426) are riding on the near-wall strip (126). The near-parapet wheels (428) are riding on the near-parapet strip (128). The near-wall wheels (426) should ideally always be aligned with the near-wall strip (126). The near-parapet wheels (428) should ideally always be aligned with the near-parapet strip (128). A dynamic axle system, attached the wheels (426, 428) to the vehicle frame, can extend the wheels (426, 428) on both sides of the minivan outwards (or retract inwards) via the independent axles. The axle for near-wall wheels (426) extends out over a distance marked by (440). The axle for near-parapet wheels (428) extends out over a distance marked by (442). With the minivan axles extended, the width from the near-wall wheel's (426) outer side to the near-parapet wheel's (428) outer side matches that of the rubber-tyred tram (402), shown in Sub-figure (a). The independent axle adjustment can ensure the wheels (426, 428) are aligned with the strips (126, 128) perfectly. Sensors mounted beside the vehicle body measure the vehicle to the central-wall (110) and vehicle to parapet (120) distances, which provide a reliable reference for the steering control system. It prevents wheels (426, 428) from physically coming in contact with the driving guides (136, 138). Electrically-powered live rails (116, 118) are bolted on top of the purlin (112). The rails (116, 118) power the electric vehicle (422) via collector shoes (416, 418).

In an alternative embodiment of the present disclosure, the modified girder would have the ability to hold a variety of vehicles. In addition to the electrically-powered rubber-tyred tram (402) and the minivan (422) mentioned above, freighter trucks, cargo vans, buses, coaches, cars, SUVs, and pick-up trucks are also compatible with the modified girder bridge. In this case of heavy-duty vehicles, the girder structure needs to be stronger, and the span needs to be shorter for such vehicles to travel safely on the bridge. In the case of vehicles with narrow track width, the dynamic axle expansion system is needed to accommodate the wide runways (146,148) separation of the bridge deck. However, some of the vehicles mentioned above are likely powered individually, and would not get their electric power from the rails (116, 118) via collector shoes. In addition to the electrically powered vehicles, vehicles with combustible engines and hybrid vehicles can use the bridge as well, provided that they match the specifications of the bridge.

Figure 5:
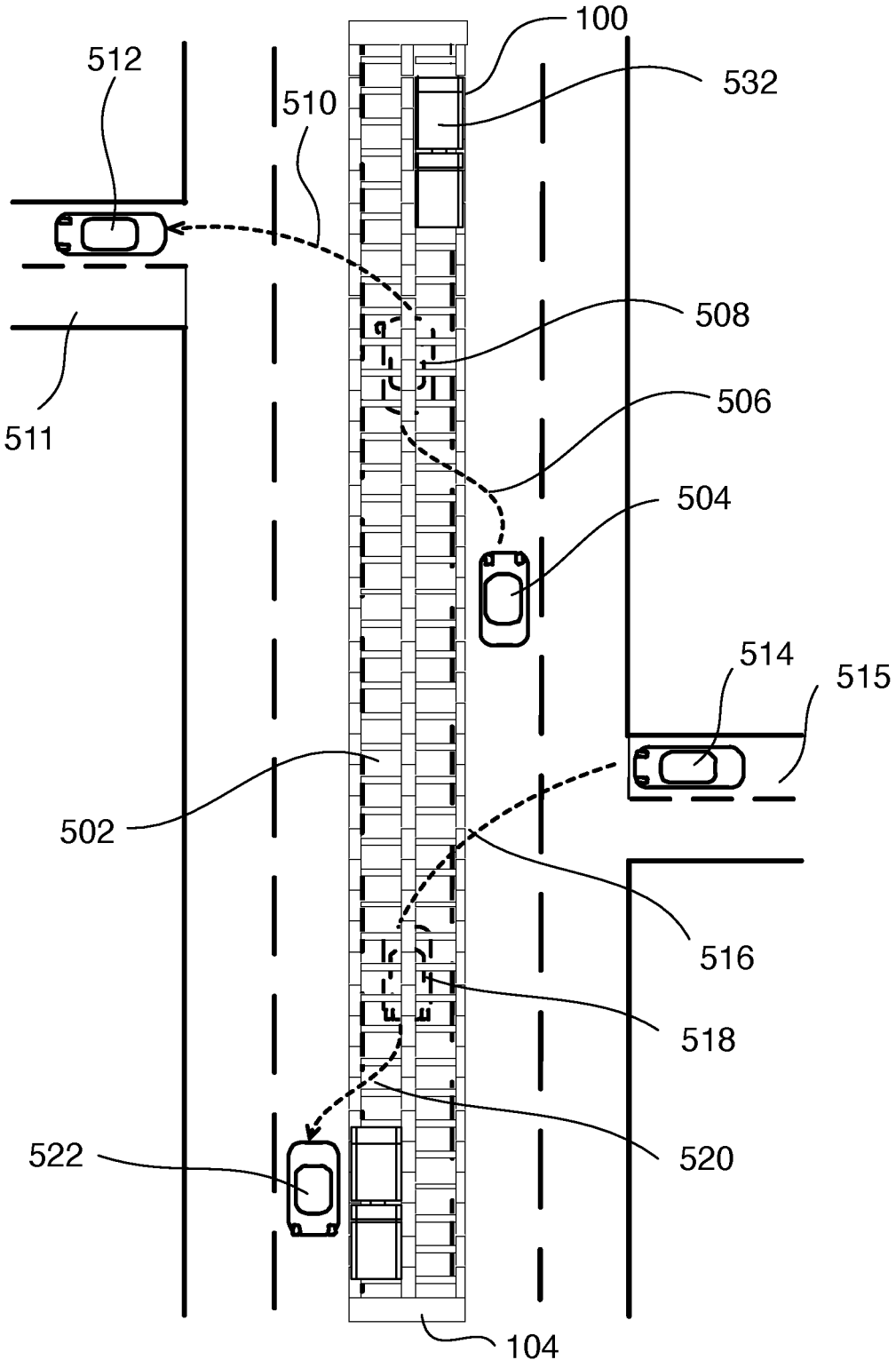
FIG. 5 illustrates an exemplary diagram of how ground-level vehicles make left turns in various situations using a center lane under the girder bridge of the present disclosure.

FIG. 5 illustrates the exemplary diagram of how ground-level vehicles make left turns in various situations using a center lane under the girder bridge of the present disclosure. Thanks to the new girder bridge design in the present disclosure, the superstructure (100) is lighter in weight, and the central-wall-beam is taller in height. This novel bridge design results in significantly extensive girder spans and slim piers. A longer span means two adjacent supporting piers can sit farther away from each other. The longer spans and slim piers facilitate ground-level traffic planning. In one embodiment of the present disclosure, a five-lane road with side streets incorporated as T-junction intersections at different locations is under a bridge girder superstructure (100) of the present disclosure. The center lane (502), also known as center left-turn lane and two-way left turn lane, is a single lane in the middle of a road that is used for cars that are turning left from either direction. The center lane (502) does not need to be continued, but it is typically wider than a regular lane.

FIG. 5 shows exactly one span of the girder bridge superstructure (100). There are vehicles (532) traveling on the bridge superstructure (100). From the top to the bottom of the figure, there is one pier (104) at the very top and another at the very bottom. There are no obstacles blocking the traffic at ground level between the two piers (104). The traffic directions can also be defined as the following: north at the top, south at the bottom, east to the right, and west to the left. There are two lanes with traffic heading northbound and the other two lanes with traffic heading southbound. A center lane (502) separates those lanes in the middle to allow vehicles to turn into the smaller side streets (511, 515). Because the bridge superstructure (100) has open decks, the natural light can shine through and illuminate the entire center lane (502).

The figure illustrates two main scenarios for making a left turn with the center lane (502) under the girder bridge of the present disclosure. The first scenario illustrates a vehicle at its initial position (504) on the road heading north, planning to make a left turn into the side street (511) at the target vehicle position (512). To make this left turn, the vehicle must first change lanes from its initial position (504) and pull into the center lane (502) at the next position (508) following the path (506) shown in the figure; ideally, the vehicle (508) will be positioned parallel to the lane boundaries of the center lane (502). The vehicle then waits for the southbound traffic on its left side to be clear. When there is a break in the traffic, the vehicle turns left to cross the two lanes and enter the side street (511) at the target vehicle position (512) following the path (510) shown in the figure.

The second scenario illustrates a vehicle at its initial position (514) of the side street (515) heading west, planning to make a left turn onto the road heading south at the target vehicle position (522). To make this left turn, the vehicle must first observe the two lanes for vehicles heading northbound. When the traffic is clear, it turns from its initial position (514) into the center lane (502) at the next position (518) following the path (516) shown in the figure. Ideally, the vehicle (518) will be positioned parallel to the lane boundaries of the center lane (502). The vehicle then waits for the southbound traffic on its right side to be clear. When there is a break in the traffic, the vehicle pulls into the adjacent right lane at the target vehicle position (522) following the path (520) shown in the figure.

Thanks to the tall wall beam (110) and low-weight superstructure (100) design, the girder bridge is erected over the center lane (502) with long spans and slim piers. As a result, the exiting five-lane road does not need to be widened in order to accommodate ground space usage by the piers (104). Also, ground traffic drivers still have a wide view of the surrounding traffic. In other words, the bridge does not affect the center lane's (502) functionality. Furthermore, its aesthetically remarkable look makes the center lane (502) or the center of the road easily identifiable from a distance. By moving and limiting public transportation onto the bridge, significant improvements can be made to road usage efficiency, traffic throughput, and transportation safety. Compared to other improvements that the girder bridge offers, aesthetic looks are relatively minor.

The preferred embodiment of the present disclosure has a road with five lanes in consideration. In an alternative embodiment of the present disclosure, the bridge is erected over a road with even numbers of lanes (e.g. four, six, or eight lanes). Although the piers (104) are slim, the widening of the road might be required to accommodate ground space usage by piers (104). Without traffic lights or other signaling systems, the vehicles might not be allowed to cross the center of the road. To mitigate this possible issue, two solid white/yellow lines can be implemented in the median of the road to indicate that the pass-over is forbidden. Additionally, there can also be barriers that separate opposite directions. Since the deck's hollow sections allow rain and sunlight to go through the girder, flower beds can be built underneath the girder to act as barriers.

Even the open deck design allows rain, hail, and snow to drop through the decks' hollow sections. It still needs gutters to catch rainwater and melted snow water from the central-wall-beam (110), parapets (120), and strips (126, 128). The gutters can be hidden in the hollow section of runways (146,148) and/or the central-wall-beam's chamber (140). In yet another exemplary embodiment of the present disclosure, the purlin holes (340, 342) are used to hold the gutters. The external gutters are more accessible and easier for maintenance. The water then drains down to the underground drainage via pipes. The gutters would ensure that no heavy water flow, snow, and ice clods fall from the girder and interfere with drivers on the road below, especially those in the center lane (502).

Figure 6:
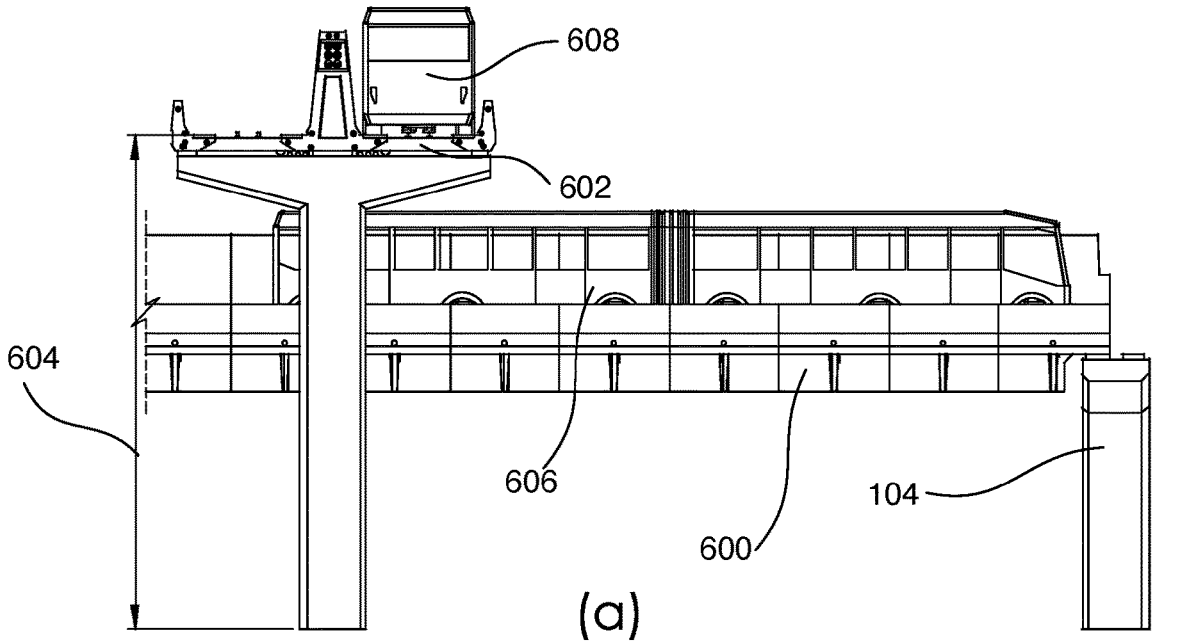
FIG. 6 illustrates a side view of two crossing girder bridges at different elevations and a front view of the elevation difference between the bridge of the present disclosure and an existing box girder bridge.
Figure 6:
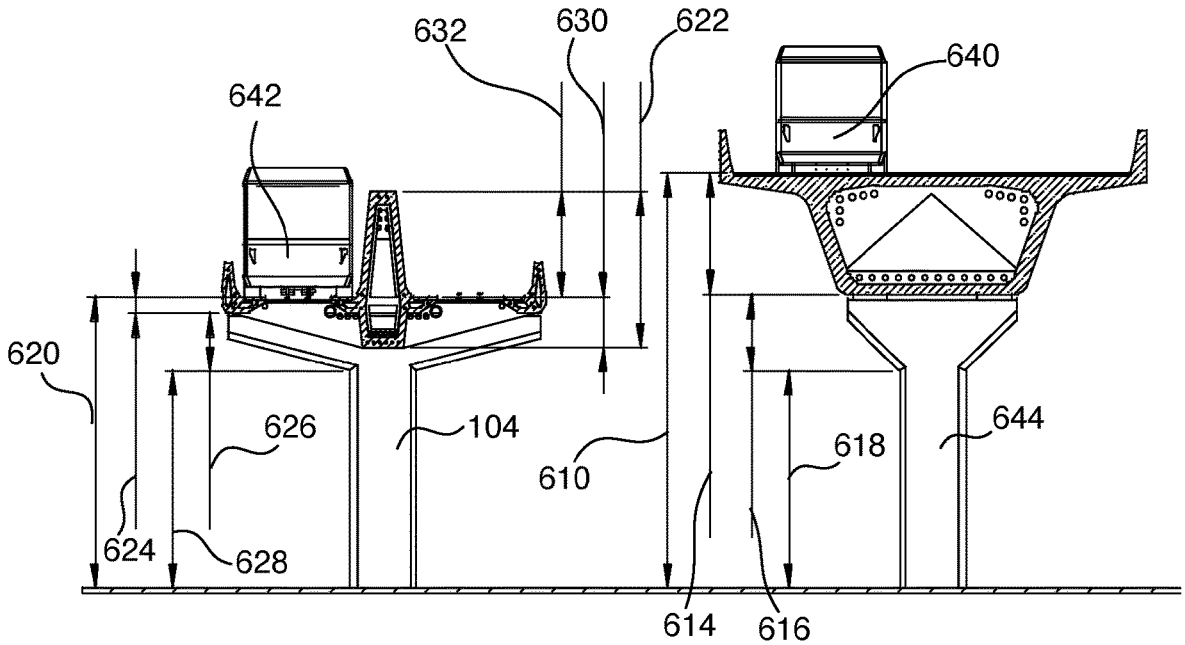

FIG. 6 illustrates a side view of two crossing girder bridges at different elevations and a front view of the elevation difference between the bridge of the present disclosure and a box girder bridge. Sub-figure (a) shows two new girder spans (600, 602) of the present disclosure. Both spans (600, 602) are supported by a pair of piers (104) on both ends of the spans (600, 602). The sub-figure primarily illustrates how two or more central-wall-beam bridges can stack efficiently to implement an urban transportation design. A first girder bridge (600) carries self-driving electric buses (606) on its open deck. A second girder bridge (602) crosses above the first bridge (600) in a perpendicular direction. The second girder bridge (602) carries self-driving electric buses (608) on its open deck. With a sufficient clearance from the top of the bus (606) on the first bridge (600) to the bottom of the central beams of the second bridge (602), the second bridge (602) deck still keeps a low elevation (604).

Thanks to the previously described design features of the girder bridge structure (600, 602) in the present disclosure, a new girder can be made with a significantly low deck elevation than a traditional box girder, T-beam, or I-beam. For the same under-bridge clearance, this means the new girder bridge of the present disclosure requires less vertical space to be built. In other words, more layers of the new girder bridges can be accommodated within that same vertical space required for traditional girder bridges. The lower deck elevation benefits both vehicles and passengers, which require less effort to reach the deck level. Furthermore, it results in less material usage.

Sub-figure (b) shows the differences in the heights of a new girder bridge structure (left) and the existing traditional box girder bridge structure (right). The pier (104) of the new bridge has a column height (628) that is comparatively similar to the traditional box girder's column height (618) of its pier (644). The clearance height of a bridge, indicated by the column heights (618, 628) in this sub-figure, is subject to the Canadian Highway Bridge Design Code and may slightly differ between provinces. The elevated deck height (620) of the new bridge girder structure is much lower than the deck height (610) of the traditional box girder design. This is because the new girder does not need the additional height of the girder used in a traditional girder to achieve a similar bridge strength and reliability. The deck elevation (620) of the new central-wall-beam design is the sum of its pier column height (628), its pier cap height (626), and its deck thickness (624). The deck elevation (610) of the traditional box girder design is the sum of its pier column height (618), its pier cap height (616), and its box girder height (614). The new girder bridge's central-wall-beam height (622) is the sum of its deck-to-top height (632) and its deck-to-bottom height (630). The deck-to-top section (632) shares the same vertical space with the vehicle (642). The deck-to-bottom section (630) shares the same vertical space with the pier cap. The saved height is the reason why the new central-wall-beam bridge has a much lower deck elevation and takes up much less vertical space.

Although the deck of the new girder design (left) is much lower than that of the traditional box girder design (right), the new girder has a similar or higher load capacity and/or longer girder span. The main reasons are due to the following: (1) due to the properties of the second moment of area, the height of a beam is the most significant factor that affects its load capacity. The girder height (622) of the central-wall-beam (110) is much higher than the traditional box girder's height (614). So, the new central-wall-beam has a higher load capacity than that of the traditional box girder; (2) the total load of the structure is the weight of the superstructure plus the weight of vehicles on the deck. The superstructure weight itself is much greater than the vehicles' weight. Thanks to the novel open-deck design, the new girder is much lighter than the box girder. So, it can support a higher load from vehicles than the traditional box girder. In other words, if both bridges have the same load capacity, the central-wall open deck girder bridge would have a lower material requirement, lower cost, and/or longer girder span.

As the vehicles (640, 642) are driving on the elevated road, which has a higher elevation than the surrounding trees, buildings, etc., the side wind effect plays a role in the vehicles' (640, 642) safe driving. In case the traffic is subject to wind force, the vehicle (640) traveling on the traditional bridge deck is at risk of tipping over, spinning out, or being blown off the bridge deck. The vehicle (642) on the new girder bridge is either traveling on the windward side or leeward side of the central-wall-beam (110). If the vehicle (642) is traveling on the windward side of the central-wall-beam (110), because the airflow is reduced and redirected by the central-wall-beam (110), it results in increased air pressure between the vehicle (642) and the central-wall-beam (110). Then, the high-pressure air at the vehicle's (642) leeward side supports the vehicle (642) against the wind flow at the vehicles' (642) windward side. Even in a wind storm, the vehicle (642) can only drift to the central-wall-beam (110) side as the vehicle (642) is eventually pushed by the extremely strong wind. The near-wall driving guide (136) supports the vehicle (642) wheels; therefore, the vehicle (642) is always safe. If the vehicle (642) is traveling on the leeward side of the central-wall-beam (110) and is shadowed by it, the wind force is applied to the wall beam (110) rather than the vehicle (642) itself. In this case, the vehicle (642) is also safe.

The reinforced concrete girder, according to the present disclosure, can be manufactured on-site or off-site. Methods involving pre-fabrication in a factory have better quality control and reduced production costs. The girder construction can be divided into the following: (1) the monolithic girders are produced off-site or on-site and then erected; (2) the girder segments are first produced in the factory. Next, the girder segments are assembled into great girder segments on the ground. Then, the great girder segments are assembled into monolithic girders on piers (104); (3) the precast girder segments are lifted individually and assembled on piers.

OPTION 1: The monolithic girders are produced in the fabrication yard or on-site, which are then erected. This solution applies to bridge structures with short spans, curves, ramps, and forks. Producing the girders in the fabrication yard is cost- and time-efficient; however, it leads to a heavy use of transportation. Furthermore, if the girders are produced on-site, it requires a long construction time and a large area of on-site ground space. Additionally, it makes noise during fabrication. Thus, this option is not suitable for construction on existing roads in an urban area.

OPTION 2: The production of the prefabricated great girder segments is divided into two stages. In the first stage, the girder segments are cast in the factory. In the second stage, the great girder segment is built with two or more girder segments, and reinforced concrete is cast between adjacent segments. This is done in accordance with the different requirements of the curve radius, slope, length, and support points. Firstly, the girder segments are placed and positioned accordingly. The molds are installed between adjacent girder segments. Then, the rebars and/or cables are placed in the tendon holes (150) of the girder segments. Wet concrete is then poured to fill the gap between two adjacent girder segments. The concrete is compacted with a vibrator. When the concrete is cured, the rebars and/or cables are stretched and anchored. The tendon holes (150) are grouted to cover the rebars and/or cables. The second stage can be done off-site or on-site. When the great girder segments are built, they are individually lifted to a predetermined height with special machinery. The tension cables are installed in the rest of the tendon holes (150). A bonding agent is then applied to the joint surface. After, the cables are stretched and anchored. The tendon holes (150) are then grouted to cover the cables. Then, the stay cable tubes and stay cables are installed in the chamber (140) of the central-wall-beam (110). The stay cables are then stretched and anchored. The stay cable tubes are grouted to cover the cables. Finally, the tube ends are capped. The cable stretching, anchoring, and pipe filling are key processes at this stage. Option 2 is applicable to bridge structures with long spans, curves, ramps, and forks. If the great girder segments are built in the factory, it leads to a heavy use of transportation. If the great girder segments are built on-site, it requires a long construction time and a large area of on-site ground space. Additionally, it makes noise during fabrication.

OPTION 3: First, girder segments are cast in the factory. When delivered to the site, the girder segments are individually lifted to a predetermined height with special machinery. The cables are installed in the tendon holes (150). A bonding agent is then applied to the joint surface. The tension cables are stretched and anchored. The tendon holes (150) are grouted to cover the cables. Then, the stay cable tubes and cables are installed in the chamber (140) of the central-wall-beam (110). The stay cables are then stretched and anchored. The stay cable tubes are grouted to cover the cables. The on-site assembly of this method is completed in the air without casting and tamping. Therefore, it has minimal impact on the existing traffic in the surrounding area and the living environment of residents. It is most suitable for construction on existing urban roads.

The invention claimed is:

1. A bridge girder between two piers for transporting vehicles with a first and second wheel-path, comprising:

a central beam located at the median of the bridge, the central beam extending upward from the bridge deck to a height greater than the height of vehicles traveling on the bridge, the central beam having a width less than its height to define a tall, slender load-bearing element, the central beam being configured to suspend and support a majority of the weight and load of the bridge and to transfer the forces thereof to the piers;

a first road deck located on one side of the central beam, the first road deck including a first lane for a first direction of vehicle traffic, the first lane comprising a first runway located under a vehicle's first wheel-path and a second runway located under the vehicle's second wheel-path; and an opening section extending between the first and second runways of the first lane and allowing air, rain, or snow to flow through the deck so as to reduce surface accumulation and aerodynamic uplift.

2. The bridge girder of claim 1, further comprising a first parapet disposed at a lateral end of the first road deck, the first parapet having a height less than the height of the central beam.

3. The bridge girder of claim 2, further comprising:

a plurality of girder segments assembled end-to-end to form the bridge girder;

a plurality of bridge girders arranged side-by-side to form a full girder bridge; and at least one pier configured to support adjacent bridge girders at a shared location.

4. The bridge girder of claim 1, wherein the central beam is hollow and includes a transverse rib structure disposed within the hollow to resist twisting.

5. The bridge girder of claim 1, wherein the central beam includes cable holes that receive prestressed cables or reinforcing bars configured to support the central beam and the first road deck.

6. The bridge girder of claim 2, further comprising a purlin linking the central beam and the first parapet, the purlin extending across and connecting the first and second runways of the first lane.

7. The bridge girder of claim 1, further comprising a second road deck located on another side of the central beam, the second road deck including a second lane for traffic in an opposite direction, the second lane comprising a third runway located under a vehicle's first wheel-path and a fourth runway located under the vehicle's second wheel-path, and an opening section extending between the third and fourth runways of the first lane and allowing air, rain, or snow to flow through the deck so as to reduce surface accumulation and aerodynamic uplift.

8. The bridge girder of claim 2, further comprising a second parapet disposed at an opposite lateral end of the bridge.

9. The bridge girder of claim 2, further comprising a first autonomous-driving vehicle reference guide associated with the first runway and a second autonomous-driving vehicle reference guide associated with the second runway, the reference guides configured to maintain vehicle wheels within their respective wheel-paths.

10. The bridge girder of claim 9, further comprising at least one reference guide disposed adjacent to the central beam and/or the parapet, the reference guide being configured for detection by a device selected from the group consisting of:

a sensor configured to provide visual detection of traffic or bridge conditions or to measure parameters including distance, wind direction, wind velocity, vehicle speed, and bridge load;

a wireless communication module configured to transmit and receive signals relating to traffic conditions, weather, map data, and vehicle status; and a traffic sign or traffic signal configured to provide regulatory indications for traffic flow.

11. The bridge girder of claim 1, wherein the runways are surfaced with a material selected from the group consisting of asphalt, concrete, metal, engineered plastic, and rubber, and wherein the runways further comprise a heating system powered by an energy source selected from the group consisting of electricity and natural gas, the heating system configured to melt snow or ice or to dry rainwater.

12. The bridge girder of claim 6, further comprising a pair of live rails disposed in each lane, the live rails mounted with fasteners and insulation and configured to supply electrical power to electric vehicles via collector shoes.

13. The bridge girder of claim 1, wherein the lane is configured for a mode of transportation selected from the group consisting of passenger buses, rubber-tyred trams, high-speed vehicles, low-speed vehicles, minivans, coaches, cars, sport-utility vehicles, freight trucks, cargo vans, and pickup trucks.

14. The bridge girder of claim 10, wherein the runways are configured to support an electrically powered vehicle having a dynamic axle system, the dynamic axle system extending or retracting wheels outward or inward via independent axles, and wherein the sensors are configured to measure distances between the vehicle and the central beam and parapets to provide input to the vehicle steering control system and to prevent the wheels from contacting the reference guides.

15. The bridge girder of claim 1, wherein a roadway beneath the bridge includes at least one two-way left-turn lane to facilitate ground-level traffic, and wherein natural light passes through the opening section of the deck.

16. The bridge girder of claim 6, wherein the cross-sectional shape of the purlin is selected from the group consisting of a rectangle, I-shape, T-shape, triangle, trapezoid, and oval.

17. The bridge girder of claim 1, wherein the piers are formed of reinforced concrete with either solid or hollow fill, and wherein the cross-sectional shape of each pier column is selected from the group consisting of a rectangle, octagon, circle, and oval.

18. A method of constructing a bridge girder between two piers for transporting vehicles with a first and second wheel-path, the method comprising:

installing a central beam at a median position of the bridge between the two piers, the central beam extending upward from a bridge deck to a height greater than the height of vehicles traveling on the bridge, the central beam having a width less than its height to define a tall, slender load-bearing element configured to suspend and support a majority of the bridge load and to transfer forces to the piers;

providing a first road deck on one side of the central beam, the first road deck including a first lane with a first runway located under a vehicle's first wheel-path and a second runway located under the vehicle's second wheel-path; and building an opening section in the first road deck between the first and second runways, the opening section being configured to allow air, rain, or snow to pass through the deck to reduce surface accumulation and aerodynamic uplift.

19. The method of claim 18, further comprising:

providing parapets at lateral ends of the bridge girder, the parapets having a height less than the central beam;

providing opening regions between paired runways of each lane, the opening regions being configured to allow air, rain, or snow to pass through the decks;

installing a thermal regulation subsystem within the runways of the decks, the subsystem being configured to supply heat to inhibit accumulation of snow or ice;

installing autonomous-vehicle guidance structures along at least one of the central beams or the decks, the guidance structures comprising physical indicators detectable by vehicle sensors for lane-keeping and navigation; and installing an electrical power rail on or within the central beam and configured to transfer electrical energy to electric vehicles traveling on the runways.

* * * * *